US007710042B2

(12) United States Patent
Shiizaki et al.

(10) Patent No.: US 7,710,042 B2
(45) Date of Patent: May 4, 2010

(54) PLASMA DISPLAY APPARATUS

(75) Inventors: Takashi Shiizaki, Yokohama (JP); Masaki Kamada, Fujisawa (JP); Akihiro Machida, Kyonan (JP); Sojiro Hagihara, Yokohama (JP)

(73) Assignee: Fujitsu Hitachi Plasma Display Limited (JP)

( * ) Notice: Subject to any disclaimer, the term of this patent is extended or adjusted under 35 U.S.C. 154(b) by 530 days.

(21) Appl. No.: 11/672,107

(22) Filed: Feb. 7, 2007

(65) Prior Publication Data

US 2008/0025057 A1 Jan. 31, 2008

(30) Foreign Application Priority Data

Jul. 27, 2006 (JP) ..... 2006-204316

(51) Int. Cl.
*G09G 3/10* (2006.01)

(52) U.S. Cl. ..... 315/169.1; 315/169.4; 315/291; 315/224; 345/94; 345/60; 345/80

(58) Field of Classification Search ..... 315/167, 315/168, 169.1–169.4, 224, 291; 345/60, 345/67–69, 76, 77, 80, 90, 92, 94, 95, 98–100, 345/102, 104
See application file for complete search history.

(56) References Cited

U.S. PATENT DOCUMENTS 5,311,169 A * 5/1994 Inada et al. ..... 345/77
6,937,213 B2 * 8/2005 Iwasa et al. ..... 345/60

FOREIGN PATENT DOCUMENTS

JP 05-143022 6/1993
JP 2002-328649 11/2002

* cited by examiner

*Primary Examiner*—Haissa Philogene
(74) *Attorney, Agent, or Firm*—Antonelli, Terry, Stout & Kraus, LLP.

(57) ABSTRACT

A PDP apparatus comprises, in a circuit part, a ramp output device which outputs a ramp wave to electrodes of a PDP. The ramp output device has a ramp generator which generates and outputs a first ramp wave of which inclination is variable, an impedance conversion circuit which receives the first ramp wave as input and outputs a second ramp wave produced by impedance conversion, and a feedback circuit which receives the second ramp wave as input and feeds it back to the input of the ramp generator. The ramp generator outputs the second ramp wave as a ramp wave (output voltage). Techniques to realize output of stabilized ramp wave in a PDP apparatus so as to stabilize PDP display operations are provided.

8 Claims, 4 Drawing Sheets

PLASMA DISPLAY APPARATUS

CROSS-REFERENCE TO RELATED APPLICATION

The present application claims priority from Japanese Patent Application No. JP 2006-204316 filed on Jul. 27, 2006, the content of which is hereby incorporated by reference into this application.

TECHNICAL FIELD OF THE INVENTION

The present invention relates to a technique for a display apparatus (plasma display apparatus: PDP apparatus) having a plasma display panel (PDP), more particularly, it relates to a circuit device which outputs a ramp wave (blunt wave) as a voltage waveform for PDP drive control.

BACKGROUND OF THE INVENTION

In a conventional PDP apparatus, for example in an operation of a reset period of sub-field drive control, ramp waves are outputted to electrodes of a PDP by ramp wave output devices (circuits).

The ramp wave output devices (ramp output devices) in the conventional PDP apparatus includes a mode such as that described in Japanese Patent Application Laid-Open Publication No. 2002-328649. This is realized by generating a ramp wave by using a capacitive load and a constant current source and outputting it via an impedance conversion circuit. This often has a circuit configuration such as that of FIG. 6 as a mode that is actually used.

In FIG. 6, in a ramp output device 900, C01 is a capacitive load, the part of E01 (voltage) and R01 (resistance) is a constant current source, and Q01 (FET: field effect transistor) performs impedance conversion. SW01 and the like are switches, Vp and the like are power sources, and SP, CU, and CD are external control inputs of the switches. The output is connected to a cell of a PDP. The right side of the ramp output device 900 is a Y output circuit of sustain waveform. The ramp output device 900 becomes active when the high level (H) of SW01 (SP) is ON as shown in FIG. 7. At that point, since the voltages of the gate and the source of Q01 are approximately the same, the voltage of E01 is applied to both ends of R01 all the time, and E01 and R01 output a constant current I=E01/R01 to C01. As a result, ramp waves are generated at both the ends of C01, and a ramp wave signal thereof is outputted via Q01. When the low level (L) of SW01 is ON, since the part between the gate and the source of Q01 is short-circuited, Q01 is caused to be in a non-operated state, and output of the ramp wave is stopped.

SUMMARY OF THE INVENTION

In the ramp output device in the conventional PDP apparatus, the capacitive load and the constant current source are used for generating a ramp wave signal, and the inclination of the ramp wave is determined by the element constants of the capacitor (C01), the resistance (R01), etc. Therefore, due to the errors of the element constants thereof, differences are occurred in the inclination of ramp waves.

Meanwhile, the ramp wave (particularly, reset waveform) used in PDP drive control realizes weak discharge by gradually varying the voltage. Therefore, as shown in FIG. 8A, a waveform that reaches a predetermined reached voltage Vp exactly at predetermined time (t) is desired. However, when the inclination is too steep as shown in FIG. 8B, discharge light emission becomes too strong, and desired performance cannot be obtained. On the contrary, when the inclination is too gentle as shown in FIG. 8C, the voltage value of the ramp wave does not reach Vp.

It has been a problem that, as described above, the ramp wave becomes unstable due to the general errors of element constants, and thus display operation becomes unstable.

The present invention is based in the view of the foregoing, and it is an object of the present invention to provide a technique which enables a stabilized ramp wave to be output in a PDP apparatus, thereby stabilizing PDP display operations.

The typical ones of the inventions disclosed in this application will be briefly described as follows. In order to accomplish the above described object, the present invention has the technical means described below which is a technique of a PDP apparatus having a PDP in which a matrix of cells of capacitive loads are formed by electrode groups and a circuit part (driving circuits, etc.) which applies voltage waveforms for drive and control to the electrodes of the PDP.

In the present PDP apparatus, the circuit part has a ramp wave output device (circuit), i.e., a ramp output device which outputs a ramp wave (blunt wave) of an applied voltage which gradually increases or gradually decreases along with time as the voltage applied to the electrodes. In the ramp output device, stabilization of the inclination of the ramp wave is realized by causing the output voltage of the ramp wave to be fed back (negative feedback).

In the present PDP apparatus, the ramp output device has: a ramp generator which generates and outputs a first ramp wave and electrically changes the inclination of the first ramp wave which is an output of the circuit; an impedance conversion circuit which receives the first ramp wave as input and outputs a second ramp wave produced by impedance conversion; and a feedback circuit which receives the second ramp wave as input and feeds it back to an input of the ramp generator, wherein the second ramp wave is outputted as the ramp wave (output voltage) applied to the electrodes.

Further, the ramp generator has a circuit element with capacitive load and a current source, and varies the current value of the current source by the voltage of the input of the circuit. The impedance conversion circuit has a circuit such as a switch which electrically short-circuits the input and the output of the circuit by an external control input. The ramp output device for example has a configuration as described below.

(1) The feedback circuit is a circuit in which the second ramp wave which is the input of the circuit is fed to a capacitor via a diode, and the output of the circuit is the voltage at both ends of the capacitor.

(2) The feedback circuit receives an external control voltage (Vr) as input and outputs a voltage (Voff) which is the difference between the second ramp wave and the external control voltage (Vr). The ramp generator receives the voltage (Voff) of the difference as input so as to determine the current value of the current source.

(3) The ramp wave generating circuit has the input which is in either one of two states, ON or OFF, increases the inclination of the first ramp wave when the input is in one of the states, and decreases the inclination when the input is in the other state. Moreover, the feedback circuit receives an external control voltage (Vr) as input and has a comparator circuit which compares the voltage values of the two inputs of the second ramp wave and the external control voltage (Vr) and outputs either one of two states, ON or OFF, in accordance with the magnitude relation of the values.

The effects obtained by typical aspects of the present invention will be briefly described below. According to the present invention, in the PDP apparatus, a stabilized ramp wave can be output, thereby stabilizing PDP display operations.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

<Outline>

Figure 1:
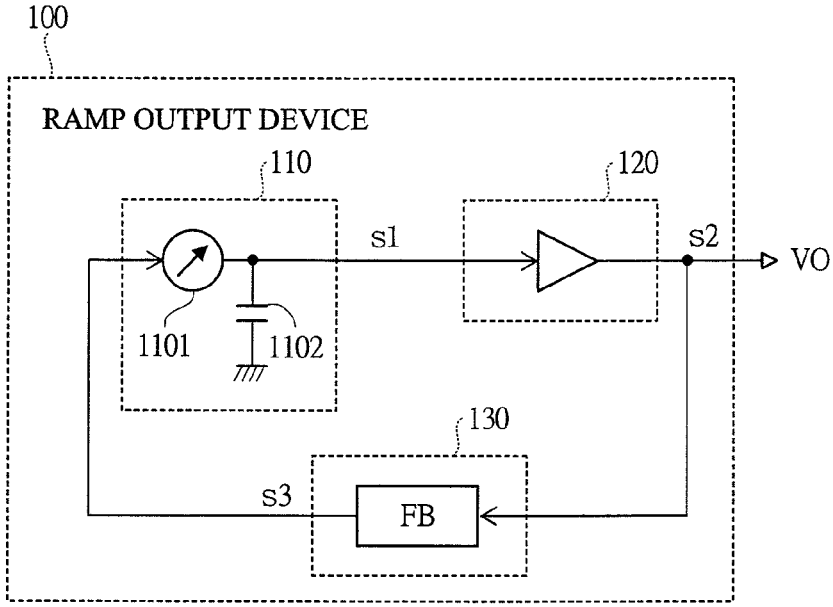
FIG. 1 is a diagram showing a block configuration of the characteristics and summary of a ramp output device in a PDP apparatus of an embodiment of the present invention.
Figure 8A:
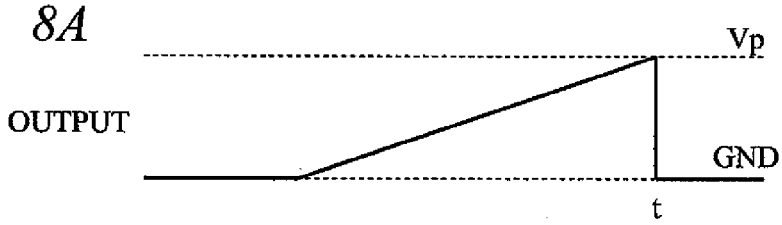
FIG. 8A (Prior Art)
FIG. 8A is a diagram showing an ideal ramp wave of a ramp output device of a conventional art.
Figure 8B:
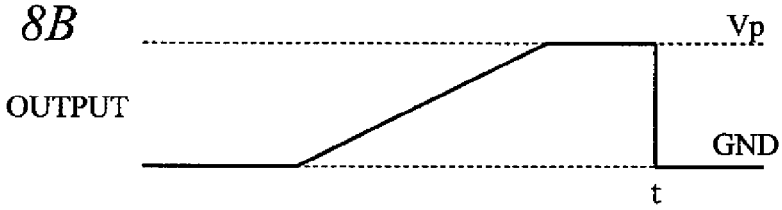
FIG. 8B (Prior Art)
FIG. 8B is a diagram showing a relation of a circuit element variation and a ramp wave in a ramp output device of a conventional art.
Figure 8C:
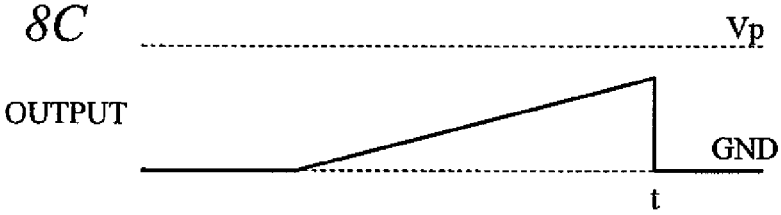
FIG. 8C (Prior Art)
FIG. 8C is a diagram showing a relation of a circuit element variation and a ramp wave in a ramp output device of a conventional art.

FIG. 1 shows a block configuration of the characteristics and summary of a ramp output device 100 in a PDP apparatus of an embodiment of the present invention. The ramp output device 100 causes an output voltage (VO) of a ramp wave generated by a ramp generator 110 to be fed back by a feedback circuit 130. Consequently, stabilization of the inclination of the ramp wave like FIG. 8A is realized. Ramp wave output devices of PDP apparatuses according to embodiments of the present invention realize the block configuration of the ramp output device 100, which has the characteristics shown in FIG. 1, by different circuit configuration details.

As shown in FIG. 1, the ramp output device 100 is specifically provided with the ramp generator 110, an impedance conversion circuit 120, and the feedback circuit 130. The ramp generator 110 has a constant current source 1101 and a capacitive load 1102 and generates and outputs a ramp wave (s1) The impedance conversion circuit 120 subjects the first ramp wave (s1) which is the output of the ramp generator 110 to impedance conversion so as to output it as a second ramp wave (s2), and this serves as the output voltage (VO) of the ramp output device 100. Then, the ramp output device 100 feeds back (negative feedback) the output voltage (VO), which is the output (s2) of the impedance conversion circuit 120, to the inclination of the ramp wave (s1) of the ramp generator 110 by the feedback circuit 130. As a result, stabilization in the ramp wave of the output voltage (VO) is realized. The ramp generator 110 is a circuit which can change the inclination of the output voltage (s1) by changing the current value of the constant current source 1101 with respect to the input voltage (s3) from the feedback circuit 130.

<PDP Apparatus>

Figure 2:
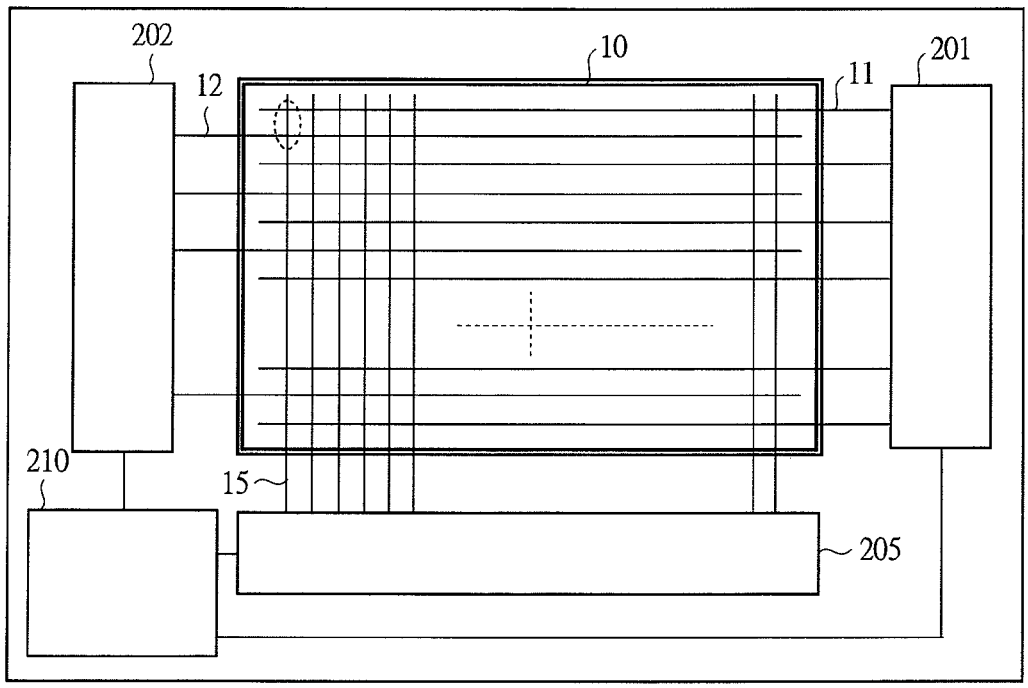
FIG. 2 is a diagram showing the overall configuration of the PDP apparatus of one embodiment of the present invention.

In FIG. 2, the overall configuration of the PDP apparatus (PDP module) of the present embodiment is described. The PDP apparatus mainly has a PDP 10 and circuit parts for drive and control thereof. The PDP module has a configuration in which the PDP 10 is attached to and held by a chassis part, which is not shown, the circuit parts are composed of ICs or the like, and, the PDP 10 and the circuit parts are electrically connected to each other.

X electrodes (sustain electrodes) 11, Y electrodes (scan electrodes) 12, and address electrodes 15 of the PDP 10 are connected to an X-electrode drive circuit 201, a Y-electrode drive circuit 202, and an address-electrode drive circuit 205, which are corresponding drive circuits (drivers), respectively, and they are driven by voltage waveforms of corresponding drive signals. The drivers (201, 202, and 205) are connected to a control circuit 210 and controlled by control signals. The control circuit 210 controls the entirety of the PDP apparatus including the drivers; i.e., it generates control signals, display data (SF data), etc. for driving the PDP 10 based on input display data (video signals) and outputs them to the drivers. A power supply circuit, which is not shown, supplies power to the circuits such as the control circuit 210.

An example of the structure of the PDP 10 will be described. A structure of a front substrate side and a structure of a rear substrate side which are mainly formed of glass are combined so that they are opposed to each other, the peripheral part thereof is sealed, and a discharge gas is sealed in the space therebetween; thus, the PDP 10 is formed. On the front substrate, the plurality of X electrodes 11 and Y electrodes 12 which are display electrodes for performing sustain discharge and the like extend in parallel in the lateral direction, and they are alternately and repeatedly formed in the vertical direction. The group of these display electrodes are covered by a dielectric layer, a protective layer, etc. On the rear substrate, the plurality of address electrodes 15 are formed to extend in parallel in the vertical direction and covered by a dielectric layer. On both sides of the address electrode 15, barrier ribs that extend in the vertical direction are formed, thereby separating them in the column direction. Furthermore, on the part between the barrier ribs, phosphors of corresponding colors which generate visible light of red (R), green (G), and blue (B) when excited by ultraviolet rays are applied. A row (line) of display is formed by a pair of the X electrode 11 and the Y electrode 12, and a cell (capacitive load) is further formed corresponding to the region where the address electrode 15 intersects therewith so that it is divided by the barrier ribs. A pixel is formed by a set of the cells of R, G, and B. The PDP 10 has various types of structures depending on, for example, the driving method, and characteristics of the present invention and the embodiments herein can be applied to the various types of the PDP 10.

The drive control method of the PDP 10 employs a general Subfield method and an Address-, Display-period Separation (ADS) method. The configuration in a field corresponding to a display region (screen) of the PDP 10 will be described. One field is composed of a plurality of subfields, which are divided in terms of time for gray scale, and each subfield is composed of a reset period, an address period, and a sustain period. Each of the subfields of the field is weighted depending on the length of the sustain period thereof, and gray scale is expressed by the combination of turning ON/OFF of the subfield.

In the reset period, a reset operation of writing (accumulating) and adjusting charge for erasing the charge produced in the sustain period of the previous subfield or preparing for the operation of the next address period is performed for the group of the cells of the subfield by applying reset waveforms to the display electrodes. In the address period, an address operation of selecting the cells to be turned ON/Off from the cell group of the subfield is performed. In the sustain period, a sustain operation of causing repetitive sustain discharge for display to be occurred in the cells (cells to be turned ON) selected in the last address period is performed. In the reset period, for example, ramp waves are applied as waveforms for charge writing or adjustment. As a result, weak discharges (reset discharges) occur in the cells, and occurrence of address discharges in the next address period is ensured.

First Embodiment

Figure 3:
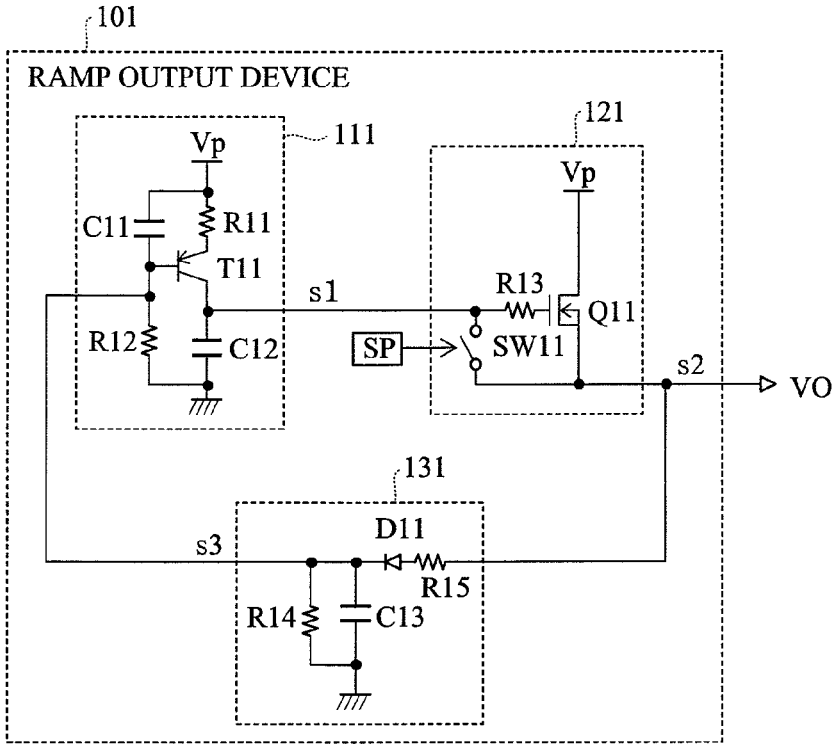
FIG. 3 is a diagram showing a circuit configuration of a ramp generator in a PDP apparatus of a first embodiment of the present invention.

In FIG. 3, the circuit configuration of a ramp output device 101 in a PDP apparatus of a first embodiment of the present invention is described. The ramp output device 101 has a configuration having a ramp generator 111, an impedance conversion circuit 121, and a feedback circuit 131. The output (s1) of the ramp generator 111 is inputted to the impedance conversion circuit 121 and subjected to impedance conversion, then the output thereof (s2) is inputted to the feedback circuit 131, and the output thereof (s3) is inputted to the ramp generator 111. The output (s2) of the impedance conversion circuit 121 serves as the output voltage (VO) of the ramp output device 101.

Figure 6:
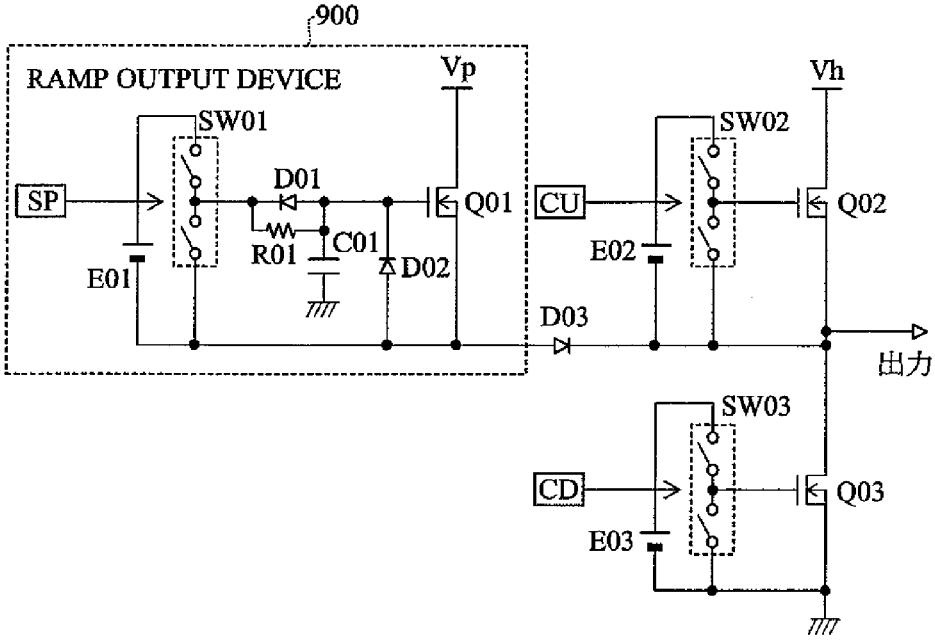
FIG. 6 (Prior Art)
FIG. 6 is a diagram showing a circuit configuration of a ramp output device 101 in a PDP apparatus of a conventional art.
Figure 7:
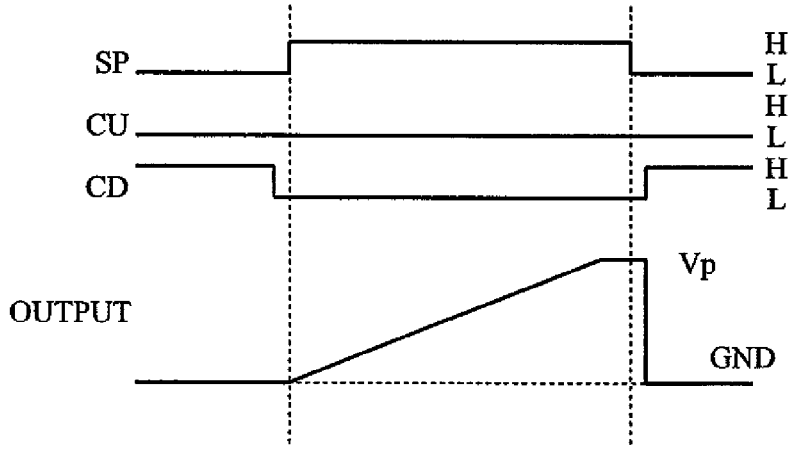
FIG. 7 (Prior Art)
FIG. 7 is a diagram for showing a control signal and an output waveform of the ramp output device of the conventional art in FIG. 6.

For example, as well as that of FIG. 6, the ramp output device 101 is formed as a reset waveform output circuit in a Y electrode drive circuit 202 and connected to a Y sustain waveform output circuit and a scan waveform output circuit.

The impedance conversion circuit 121 has a configuration approximately the same as the conventional circuit and switches operation/non-operation by opening/short-circuiting the part between the gate and the source of an FET Q11 by a switch SW11.

The ramp generator 111 is a circuit in which the inclination of the ramp wave that is the output (s1) is changed with respect to the input voltage (s3). The part of a capacitor C11, a resistance R11, and a transistor T11 forms a constant current source, and the current value thereof is the value that is the voltage across both ends of the capacitor C11 divided by the resistance value of the resistance R11. Therefore, when the input voltage (s3) is Vi, the inclination of the ramp wave (s1) is (Vp−Vi)/R11)/C11.

The feedback circuit 131 is a circuit which returns the crest value of the ramp wave that is the output (s2, VO) of the ramp output device 101 as the output (s3).

The ramp output device 101 operates in the following manner. When the crest value of the ramp wave (s1) reaches Vp, the device is operated so that the inclination thereof is made gentler, in other words, the crest value is lowered by feedback of the feedback circuit 131. By contraries, when the crest value of the ramp wave is lowered, feedback is made so that the waveform is made steeper, in other words, the crest value is increased. As a result, the crest value of the ramp wave is stabilized at a voltage slightly below Vp. The difference between the crest value of the ramp wave and Vp can be adjusted by resistances R14 and R15 of the feedback circuit 131. When the resistance value of R15 is sufficiently small with respect to R14, the crest value becomes approximately same as Vp.

According to the first embodiment, a stabilized ramp wave such as that of FIG. 8A can be output.

Second Embodiment

Figure 4:
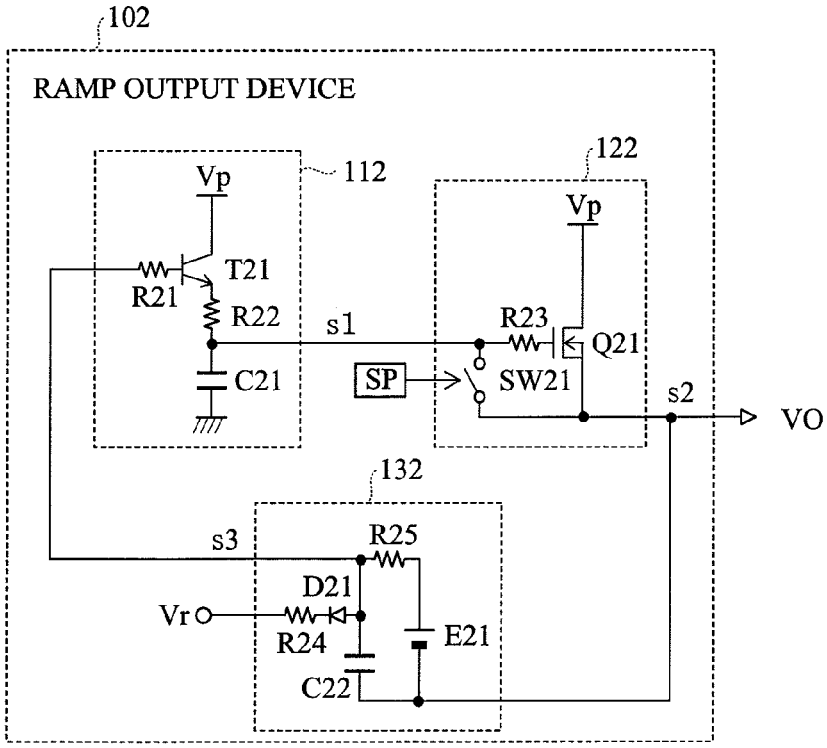
FIG. 4 is a diagram showing a circuit configuration of a ramp output device 101 in a PDP apparatus of a second embodiment of the present invention.

Next, in FIG. 4, the circuit configuration of a ramp output device 102 in a PDP apparatus of a second embodiment of the present invention will be described. The ramp output device 102 has a configuration having a ramp generator 112, an impedance conversion circuit 122, and a feedback circuit 132. The output (s1) of the ramp generator 112 is inputted to the impedance conversion circuit 122 and subjected to impedance conversion, then the output thereof (s2) is inputted to the feedback circuit 132, and the output thereof (s3) is inputted to the ramp generator 112. The output (s2) of the impedance conversion circuit 122 serves as the output voltage (VO) of the ramp output device 102.

The ramp output device 102 of the second embodiment has a circuit configuration in which the crest value of the ramp wave can be externally controlled. The crest value can be controlled by an input Vr of the feedback circuit 132. The voltage across both ends of a capacitor C22 of the feedback circuit 132 is an offset voltage (Voff).

The output (s3) of the feedback circuit 132 is a value (VO+Voff) that is the sum of the output voltage (VO) of the ramp output device 102 and the offset voltage (Voff). When the value thereof exceeds Vr (VO+Voff>Vr), the output acts so that the offset voltage (Voff) is reduced. Inversely, when the value thereof is equal to or less than Vr (VO+Voff≦Vr), the output acts so that the offset voltage (Voff) is increased.

The ramp generator 112 is a circuit in which the inclination of the ramp wave (s1) is changed by the offset voltage (Voff) from the feedback circuit 132. The output (s1) of the ramp generator 112 is approximately the same as the output voltage (s2) of the impedance conversion circuit 122, and the emitter voltage of a transistor T21 is approximately the same as the input voltage (s1). Therefore, the offset voltage (Voff) is applied to a resistance R22. Thus, with respect to the offset voltage (Voff), the inclination of the ramp wave (s1) is (Voff/R22)/C21.

In the ramp output device 102, strictly speaking, the crest value of the ramp wave is stabilized at a voltage slightly lower than Vr.

According to the second embodiment, a stabilized ramp wave such as that of FIG. 8A can be output.

Third Embodiment

Figure 5:
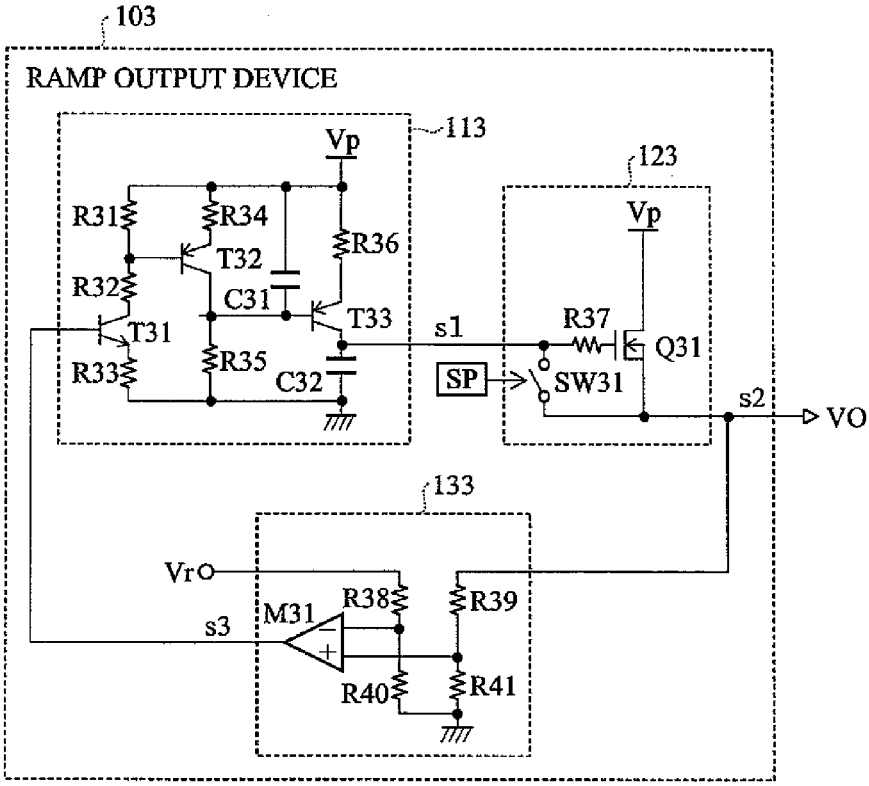
FIG. 5 is a diagram showing a circuit configuration of a ramp output device 101 in a PDP apparatus of a third embodiment of the present invention.

Next, in FIG. 5, the circuit configuration of a ramp output device 103 in a PDP apparatus of a third embodiment of the present invention is described. The ramp output device 103 has a configuration having a ramp generator 113, an impedance conversion circuit 123, and a feedback circuit 133. The output (s1) of the ramp generator 113 is inputted to the impedance conversion circuit 123 and subjected to impedance conversion, then the output thereof (s2) is inputted to the feedback circuit 133, and the output thereof (s3) is inputted to the ramp generator 113. The output (s2) of the impedance conversion circuit 123 serves as the output voltage (VO) of the ramp output device 103.

In the above described second embodiment, the output voltage (VO) is stabilized at a value lower than Vr by the amount corresponding to the offset voltage (Voff). However, in the present third embodiment, by virtue of the configuration in which a comparator circuit is used as the feedback circuit 133, the output voltage (VO) is stabilized at the same value as Vr. M31 is a comparator.

The feedback circuit 133 is a comparator circuit of the output voltage (VO) and the input Vr which are two inputs, and has a binary output (s3). As the binary output (s3) of the comparator circuit, a high level (H) is outputted when the output voltage (VO)>Vr, and a low level (L) is outputted when the output voltage (VO)<Vr.

The ramp generator 113 has the binary input of ON (H)/OFF (L) from the feedback circuit 133, reduces the inclination of the ramp wave (s1) when it is in the ON (H) state, and increases the inclination of the ramp wave (s1) when it is in the OFF (L) state. Mainly, the inclination is reduced/increased in a transistor T31. The ON/OFF of the input (s3) is transmitted to a transistor T32 via the transistor T31, thereby increasing/reducing the voltage applied to both ends of a capacitor C31. The operation of a transistor T33 is the same as the case of the first embodiment.

The ramp output device 103 is stabilized when that the crest value of the ramp wave becomes Vr. Furthermore, when resistances R38, R39, R40, and R41 of the feedback circuit 133 are adjusted, an operation can be implemented on the crest value of the ramp wave. The crest value is a function of Vr, and the relational ratio of VO and Vr can be changed.

According to the third embodiment, a stabilized ramp wave such as that of FIG. 8A can be output.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be utilized in an apparatus such as a plasma display apparatus which outputs a ramp wave.

What is claimed is:

1. A plasma display apparatus comprising:

a plasma display panel in which a capacitive load is formed by a plurality of electrodes; and a circuit part which applies a drive voltage to the electrodes, wherein the circuit part has a ramp output device which outputs a ramp wave of an applied voltage which gradually increases or gradually decreases along with time as the voltage applied to the electrodes;

the ramp output device comprises:

a ramp generator which generates and outputs a first ramp wave and electrically changes the inclination of the first ramp wave which is an output of the circuit;

an impedance conversion circuit which receives the first ramp wave as input and outputs a second ramp wave produced by impedance conversion; and a feedback circuit which receives the second ramp wave as input and feeds it back to an input of the ramp wave generating circuit, and the second ramp wave is outputted as the ramp wave applied to the electrodes.

2. The plasma display apparatus according to claim 1, wherein the ramp generator has a circuit element with capacitive load and a current source, and varies the current value of the current source by the voltage of the input of the circuit.

3. The plasma display apparatus according to claim 1, wherein the impedance conversion circuit has a circuit which electrically short-circuits the input and the output of the circuit by an external control input.

4. The plasma display apparatus according to claim 1, wherein, in the feedback circuit, the input of the circuit is fed to a capacitor via a diode, and the output of the circuit is the voltage at both ends of the capacitor.

5. The plasma display apparatus according to claim 2, wherein the feedback circuit receives an external control voltage as input and outputs a voltage which is the difference between the second ramp wave and the external control voltage, and the ramp generator receives the voltage of the difference as input so as to determine the current value of the current source.

6. The plasma display apparatus according to claim 1, wherein the ramp generator has the input which is in either one of two states, ON or OFF, increases the inclination of the first ramp wave when the input is in one of the states, and decreases the inclination when the input is in the other state.

7. The plasma display apparatus according to claim 1, wherein the feedback circuit receives an external control voltage as input and has a comparator circuit which compares the voltage values of the two inputs of the second ramp wave and the external control voltage, and outputs either one of two states, ON or OFF, in accordance with the magnitude relation of the values.

8. The plasma display apparatus according to claim 1, wherein an X electrode, a Y electrode, and an address electrode are provided as the electrodes, the circuit part has a Y-electrode drive circuit which applies waveforms of reset, scan, and sustain to the Y electrode as drive voltages, and the ramp output device is provided as a circuit which outputs the waveform of the reset in the Y-electrode drive circuit.

* * * * *